US007340391B2

(12) United States Patent
Herre et al.

(10) Patent No.: US 7,340,391 B2
(45) Date of Patent: Mar. 4, 2008

(54) APPARATUS AND METHOD FOR PROCESSING A MULTI-CHANNEL SIGNAL

(75) Inventors: Juergen Herre, Erlangen (DE); Michael Schug, Erlangen (DE); Alexander Groeschel, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 11/464,315

(22) Filed: Aug. 14, 2006

(65) Prior Publication Data

US 2007/0033056 A1 Feb. 8, 2007

Related U.S. Application Data

(63) Continuation of application No. PCT/EP2005/002110, filed on Feb. 28, 2005.

(30) Foreign Application Priority Data

Mar. 1, 2004 (DE) ..... 10 2004 009 954

(51) Int. Cl.
*G10L 19/04* (2006.01)

(52) U.S. Cl. ..... 704/200.1; 704/219

(58) Field of Classification Search ..... None
See application file for complete search history.

(56) References Cited

U.S. PATENT DOCUMENTS 5,812,971 A * 9/1998 Herre ..... 704/230
6,052,659 A * 4/2000 Mermelstein ..... 704/219
6,622,117 B2 * 9/2003 Deligne et al. ..... 702/190
6,771,723 B1 * 8/2004 Davis et al. ..... 375/350
2005/0041530 A1 * 2/2005 Goudie et al. ..... 367/138
2005/0213522 A1 * 9/2005 Aarts et al. ..... 370/278

FOREIGN PATENT DOCUMENTS

DE 198 29 284 A1 11/1999
DE 198 29 284 C2 11/1999

OTHER PUBLICATIONS

ISO/IEC JTC1/SC29/WG11, Kap. B.2.4., Kap. 7, Kap. 12-14, 1998.
Domazet D. et al., "Advanced Software Implementation of MPEG-4 AAC Audio Encoder," Video/Image Processing and Multimedia Communications, 2003. 4th Eurasip Conference Focused on Jul. 2-5, 2003, Piscataway, NJ, USA, IEEE, vol. 2, Jul. 2, 2003, pp. 679-684.

(Continued)

*Primary Examiner*—Abul K. Azad
(74) *Attorney, Agent, or Firm*—Daniel J. Santos

(57) ABSTRACT

An apparatus for processing a multi-channel signal includes a means for determining a similarity between a first one of two channels and a second one of the two channels. Furthermore, a means for performing a prediction filtering of the spectral coefficients is provided, which is formed to perform a prediction filtering with only a single prediction filter for both channels in case of high similarity between the first and the second channel, and to perform a prediction filtering with two separate prediction filters in case of a dissimilarity between the first and the second channel. With this, an introduction of stereo artifacts and a deterioration of the coding gain in stereo coding techniques are avoided.

12 Claims, 3 Drawing Sheets

OTHER PUBLICATIONS

Brandenburg K. et al., "MPEG-4 Natural Audio Coding" Signal Processing. Image Communication, Elsevier Science Publishers, Amsterdam, NL, vol. 15, Jan. 2000, pp. 423-444.

Bosi et al., "ISO/IEC MPEG-2 Advanced Audio Coding," J. Audio Eng. Soc., vol. 45, No. 10, Oct. 1997, pp. 789-814.

ISO/IEC 14496-3, 2001 (E), subpart 4, p. 4.

* cited by examiner

APPARATUS AND METHOD FOR PROCESSING A MULTI-CHANNEL SIGNAL

CROSS-REFERENCE TO RELATED APPLICATION

This application is a continuation of co-pending International Application No. PCT/EP2005/002110, filed Feb. 28, 2005, which designated the United States and was not published in English and is incorporated herein by reference in its entirety, and which claims priority to German Patent Application No. 102004009954.5-31, filed Mar. 1, 2004.

BACKGROUND OF THE INVENTION

1. Field of the Invention

The present invention relates to audio coders and particularly to audio coders that are transformation-based, i.e. in which a conversion of a temporal representation to a spectral representation takes place at the beginning of the coder pipeline.

2. Description of the Related Art

A known transformation-based audio coder is shown in FIG. 3. The coder shown in FIG. 3 is illustrated in the international standard ISO/IEC 14496-3: 2001 (E), subpart 4, page 4, and also known as AAC coder in technology.

The prior art coder will be presented below. An audio signal to be coded is supplied in at an input 1000. This audio signal is initially fed to a scaling stage 1002, wherein so-called AAC gain control is conducted to establish the level of the audio signal. Side information from the scaling is supplied to a bit stream formatter 1004, as is represented by the arrow located between block 1002 and block 1004. The scaled audio signal is then supplied to an MDCT filter bank 1006. With the AAC coder, the filter bank implements a modified discrete cosine transformation with 50% overlapping windows, the window length being determined by a block 1008.

Generally speaking, block 1008 is present for the purpose of windowing transient signals with relatively short windows, and of windowing signals which tend to be stationary with relatively long windows. This serves to reach a higher level of time resolution (at the expense of frequency resolution) for transient signals due to the relatively short windows, whereas for signals which tend to be stationary, a higher frequency resolution (at the expense of time resolution) is achieved due to longer windows, there being a tendency of preferring longer windows since they result in a higher coding gain. At the output of filter bank 1006, blocks of spectral values—the blocks being successive in time—are present which may be MDCT coefficients, Fourier coefficients or subband signals, depending on the implementation of the filter bank, each subband signal having a specific limited bandwidth specified by the respective subband channel in filter bank 1006, and each subband signal having a specific number of subband samples.

What follows is a presentation, by way of example, of the case wherein the filter bank outputs temporally successive blocks of MDCT spectral coefficients which, generally speaking, represent successive short-term spectra of the audio signal to be coded at input 1000. A block of MDCT spectral values is then fed into a TNS processing block 1010 (TNS=temporary noise shaping), wherein temporal noise shaping is performed. The TNS technique is used to shape the temporal form of the quantization noise within each window of the transformation. This is achieved by applying a filtering process to parts of the spectral data of each channel. Coding is performed on a window basis. In particular, the following steps are performed to apply the TNS tool to a window of spectral data, i.e. to a block of spectral values.

Initially, a frequency range for the TNS tool is selected. A suitable selection comprises covering a frequency range of 1.5 kHz with a filter, up to the highest possible scale factor band. It shall be pointed out that this frequency range depends on the sampling rate, as is specified in the AAC standard (ISO/IEC 14496-3: 2001 (E)).

Subsequently, an LPC calculation (LPC=linear predictive coding) is performed, to be precise using the spectral MDCT coefficients present in the selected target frequency range. For increased stability, coefficients which correspond to frequencies below 2.5 kHz are excluded from this process. Common LPC procedures as are known from speech processing may be used for LPC calculation, for example the known Levinson-Durbin algorithm. The calculation is performed for the maximally admissible order of the noise-shaping filter.

As a result of the LPC calculation, the expected prediction gain PG is obtained. In addition, the reflection coefficients, or Parcor coefficients, are obtained.

If the prediction gain does not exceed a specific threshold, the TNS tool is not applied. In this case, a piece of control information is written into the bit stream so that a decoder knows that no TNS processing has been performed.

However, if the prediction gain exceeds a threshold, TNS processing is applied.

In a next step, the reflection coefficients are quantized. The order of the noise-shaping filter used is determined by removing all reflection coefficients having an absolute value smaller than a threshold from the "tail" of the array of reflection coefficients. The number of remaining reflection coefficients is in the order of magnitude of the noise-shaping filter. A suitable threshold is 0.1.

The remaining reflection coefficients are typically converted into linear prediction coefficients, this technique also being known as "step-up" procedure.

The LPC coefficients calculated are then used as coder noise shaping filter coefficients, i.e. as prediction filter coefficients. This FIR filter is used for filtering in the specified target frequency range. An autoregressive filter is used in decoding, whereas a so-called moving average filter is used in coding. Eventually, the side information for the TNS tool is supplied to the bit stream formatter, as is represented by the arrow shown between the TNS processing block 1010 and the bit stream formatter 1004 in FIG. 3.

Then, several optional tools which are not shown in FIG. 3 are passed through, such as a long-term prediction tool, an intensity/coupling tool, a prediction tool, a noise substitution tool, until eventually a mid/side coder 1012 is arrived at. The mid/side coder 1012 is active when the audio signal to be coded is a multi-channel signal, i.e. a stereo signal having a left-hand channel and a right-hand channel. Up to now, i.e. upstream from block 1012 in FIG. 3, the left-hand and right-hand stereo channels have been processed, i.e. scaled, transformed by the filter bank, subjected to TNS processing or not, etc., separately from one another.

In the mid/side coder, verification is initially performed as to whether a mid/side coding makes sense, i.e. will yield a coding gain at all. Mid/side coding will yield a coding gain if the left-hand and right-hand channels tend to be similar, since in this case, the mid channel, i.e. the sum of the left-hand and the right-hand channels, is almost equal to the left-hand channel or the right-hand channel, apart from scaling by a factor of ½, whereas the side channel has only very small values since it is equal to the difference between the left-hand and the right-hand channels. As a consequence, one can see that when the left-hand and right-hand channels are approximately the same, the difference is approximately zero, or includes only very small values which—this is the hope—will be quantized to zero in a subsequent quantizer 1014, and thus may be transmitted in a very efficient manner since an entropy coder 1016 is connected downstream from quantizer 1014.

Quantizer 1014 is supplied an admissible interference per scale factor band by a psycho-acoustic model 1020. The quantizer operates in an iterative manner, i.e. an outer iteration loop is initially called up, which will then call up an inner iteration loop. Generally speaking, starting from quantizer step-size starting values, a quantization of a block of values is initially performed at the input of quantizer 1014. In particular, the inner loop quantizes the MDCT coefficients, a specific number of bits being consumed in the process. The outer loop calculates the distortion and modified energy of the coefficients using the scale factor so as to again call up an inner loop. This process is iterated for such time until a specific conditional clause is met. For each iteration in the outer iteration loop, the signal is reconstructed so as to calculate the interference introduced by the quantization, and to compare it with the permitted interference supplied by the psycho-acoustic model 1020. In addition, the scale factors of those frequency bands which after this comparison still are considered to be interfered with are enlarged by one or more stages from iteration to iteration, to be precise for each iteration of the outer iteration loop.

Once a situation is reached wherein the quantization interference introduced by the quantization is below the permitted interference determined by the psycho-acoustic model, and if at the same time bit requirements are met, which state, to be precise, that a maximum bit rate be not exceeded, the iteration, i.e. the analysis-by-synthesis method, is terminated, and the scale factors obtained are coded as is illustrated in block 1014, and are supplied, in coded form, to bit stream formatter 1004 as is marked by the arrow which is drawn between block 1014 and block 1004. The quantized values are then supplied to entropy coder 1016, which typically performs entropy coding for various scale factor bands using several Huffman-code tables, so as to translate the quantized values into a binary format. As is known, entropy coding in the form of Huffman coding involves falling back on code tables which are created on the basis of expected signal statistics, and wherein frequently occurring values are given shorter code words than less frequently occurring values. The entropy-coded values are then supplied, as actual main information, to bit stream formatter 1004, which then outputs the coded audio signal at the output side in accordance with a specific bit stream syntax.

As it has already been set forth, prediction filtering is used for the temporal shaping of the quantization noise within a coding frame in the TNS processing block 1010.

In particular, the temporal shaping of the quantization noise is done by filtering the spectral coefficients over the frequency in the encoder prior to the quantization and ensuing inverse filtering in the decoder. The TNS processing causes the envelope of the quantization noise to be shifted in time below the envelope of the signal, in order to avoid pre-echo artifacts. The application of the TNS results from an estimation of the prediction gain of the filtering, as it has been set forth previously. The filter coefficients for each coding frame are determined via a correlation measure. The calculation of the filter coefficients is done separately for each channel. They are also transmitted separately in the encoded bit stream.

It is disadvantageous in the activation/deactivation of the TNS concept that for each stereo channel the TNS filtering takes place separately for each channel, once a TNS processing has been activated due to a good anticipated coding gain. With relatively different channels this is still unproblematic. But if the left and the right channel are relatively similar, i.e. if the left and the right channel have exactly the same useful information, in an extreme example, such as a speaker, and only differ regarding the noise inevitably contained in the channels, for each channel still a TNS filter of its own is calculated and used in the prior art. Since the TNS filter directly depends on the left and/or right channel and, in particular, reacts relatively sensitively to the spectral data of the left and of the right channel, a TNS processing with a prediction filter of its own is performed for each channel also in the case of a signal in which the left and the right channel are very similar, i.e. in the case of a so-called "quasi-mono signal". This leads to a different temporal noise shaping also taking place in the two stereo channels due to the different filter coefficients.

It is disadvantageous in this effect that it may lead to audible artifacts, since for example the original mono-like sound impression obtains an undesired stereo character through these temporal differences.

The known procedure, however, has a further, possibly even more serious disadvantage. By the TNS processing, the TNS output values, i.e. the spectral residual values, are subjected to a mid/side coding in the mid/side coder 1002 of FIG. 3. While the two channels were still relatively equal prior to the TNS processing, this can no longer be said after the TNS processing. By the stereo effect described, which has been introduced by the separate TNS processing, the spectral residual values of the two channels are made more dissimilar than they would actually be. This leads to an immediate drop in coding gain due to the mid/side coding, which is particularly disadvantageous for applications in which a low bit rate is required, in particular.

In summary, the known TNS activation thus is problematic for stereo signals using similar, but not exactly identical signal information in both channels, such as mono-like voice signals. As long as different filter coefficients are determined for both channels in the TNS detection, this leads to a temporally different shaping of the quantization noise in the channels. This may lead to audible artifacts, since the original mono-like sound impression obtains an undesired stereo character through these temporal differences, for example. Furthermore, as it has been set forth, the TNS-modified spectrum is subjected to a mid/side coding in a subsequent step. Different filters in both channels additionally reduce the similarity of the spectral coefficients, and thus the mid/side gain.

DE 19829284C2 discloses a method and an apparatus for processing a temporal stereo signal and a method and an apparatus for decoding an audio bit stream encoded using a prediction over the frequency. Depending on the implementation, the left, the right, and the mono channel may be subjected to a prediction of their own over the frequency, i.e. a TNS processing. Thus, a complete prediction of its own may be performed for each channel. Alternatively, in an incomplete prediction, a calculation of the prediction coefficients for the left channel may take place, which are then employed for the filtering of the right channel and the mono channel.

SUMMARY OF THE INVENTION

It is an object of the present invention to provide a concept for processing a multi-channel signal enabling fewer artifacts but still good compression of the information.

In accordance with a first aspect, the present invention provides an apparatus for processing a multi-channel signal, wherein the multi-channel signal is represented by a block of spectral values each for at least two channels, having: a similarity determinator for determining a similarity between a first one of the two channels and a second one of the two channels, wherein the similarity determinator is formed to calculate a first prediction gain from a prediction of the block of the first channel and a second prediction gain from a prediction of the block of the second channel, or first reflection coefficients for a first prediction filter for the first channel and second reflection coefficients for a second prediction filter of the second channel, and to obtain the similarity using the first prediction gain and the second prediction gain or using the first reflection coefficients and the second reflection coefficients; a prediction filter processor performing a prediction filtering, wherein the prediction filter processor is formed to use a common prediction filter for the block of spectral values of the first channel and the block of spectral values of the second channel for performing the prediction filtering if a similarity is greater than a threshold similarity, or use two different prediction filters for performing the prediction filtering if the similarity is smaller than a threshold similarity.

In accordance with a second aspect, the present invention provides a method of processing a multi-channel signal, wherein the multi-channel signal is represented by a block of spectral values each for at least two channels, with the steps of: determining a similarity between a first one of the two channels and a second one of the two channels by calculating a first prediction gain from a prediction of the block of the first channel and a second prediction gain from a prediction of the block of the second channel, in order to obtain the similarity from the first prediction gain and the second prediction gain, or by calculating first reflection coefficients for a first prediction filter for the first channel and second reflection coefficients for a second prediction filter of the second channel, in order to obtain the similarity using the first reflection coefficients and the second reflection coefficients; performing a prediction filtering with a common prediction filter for the block of spectral values of the first channel and the block of spectral values of the second channel if a similarity is greater than a threshold similarity, or performing the prediction filtering with two different prediction filters for the block of spectral values of the first channel and the block of spectral values of the second channel if the similarity is smaller than a threshold similarity.

In accordance with a third aspect, the present invention provides a computer program with program code for performing, when the program is executed on a computer, a method of processing a multi-channel signal, wherein the multi-channel signal is represented by a block of spectral values each for at least two channels, having the steps of: determining a similarity between a first one of the two channels and a second one of the two channels by calculating a first prediction gain from a prediction of the block of the first channel and a second prediction gain from a prediction of the block of the second channel, in order to obtain the similarity from the first prediction gain and the second prediction gain, or by calculating first reflection coefficients for a first prediction filter for the first channel and second reflection coefficients for a second prediction filter of the second channel, in order to obtain the similarity using the first reflection coefficients and the second reflection coefficients; performing a prediction filtering with a common prediction filter for the block of spectral values of the first channel and the block of spectral values of the second channel if a similarity is greater than a threshold similarity, or performing the prediction filtering with two different prediction filters for the block of spectral values of the first channel and the block of spectral values of the second channel if the similarity is smaller than a threshold similarity.

The present invention is based on the finding that, if the left and the right channel are similar, i.e. exceed a similarity measure, the same TNS filtering is to be applied for both channels. With this, it is ensured that no pseudo-stereo artifacts are introduced into the multi-channel signal by the TNS processing, since by the use of the same prediction filter for both channels it is achieved that the temporal shaping of the quantization noise also takes place identically for both channels, i.e. that no pseudo-stereo artifacts are audible.

Moreover, it is ensured that the signals do not become more dissimilar than they actually would have to be. The similarity of the signals after the TNS filtering, i.e. the similarity of the spectral residual values, here corresponds to the similarity of the input signals into the filters and not, like in the prior art, the similarity of the input signals, which will still be reduced by different filters.

Thus, a subsequent mid/side coding will have no bit rate losses, since the signals have not been made more dissimilar than they actually are.

Of course, by using the same prediction filter for both signals, a small loss in prediction gain will occur. This loss will, however, not be so great, since the synchronization of the TNS filtering for both channels is only employed when the two channels are similar to each other anyway. This small loss in prediction gain is, however, as it has turned out, easily balanced by the mid/side gain, since no additional dissimilarity between left and right channel, which would lead to a reduction in the mid/side coding gain, is introduced by the TNS processing.

BRIEF DESCRIPTION OF THE DRAWINGS

These and other objects and features of the present invention will become clear from the following description taken in conjunction with the accompanying drawings, in which.

DESCRIPTION OF THE PREFERRED EMBODIMENTS

Figure 1:
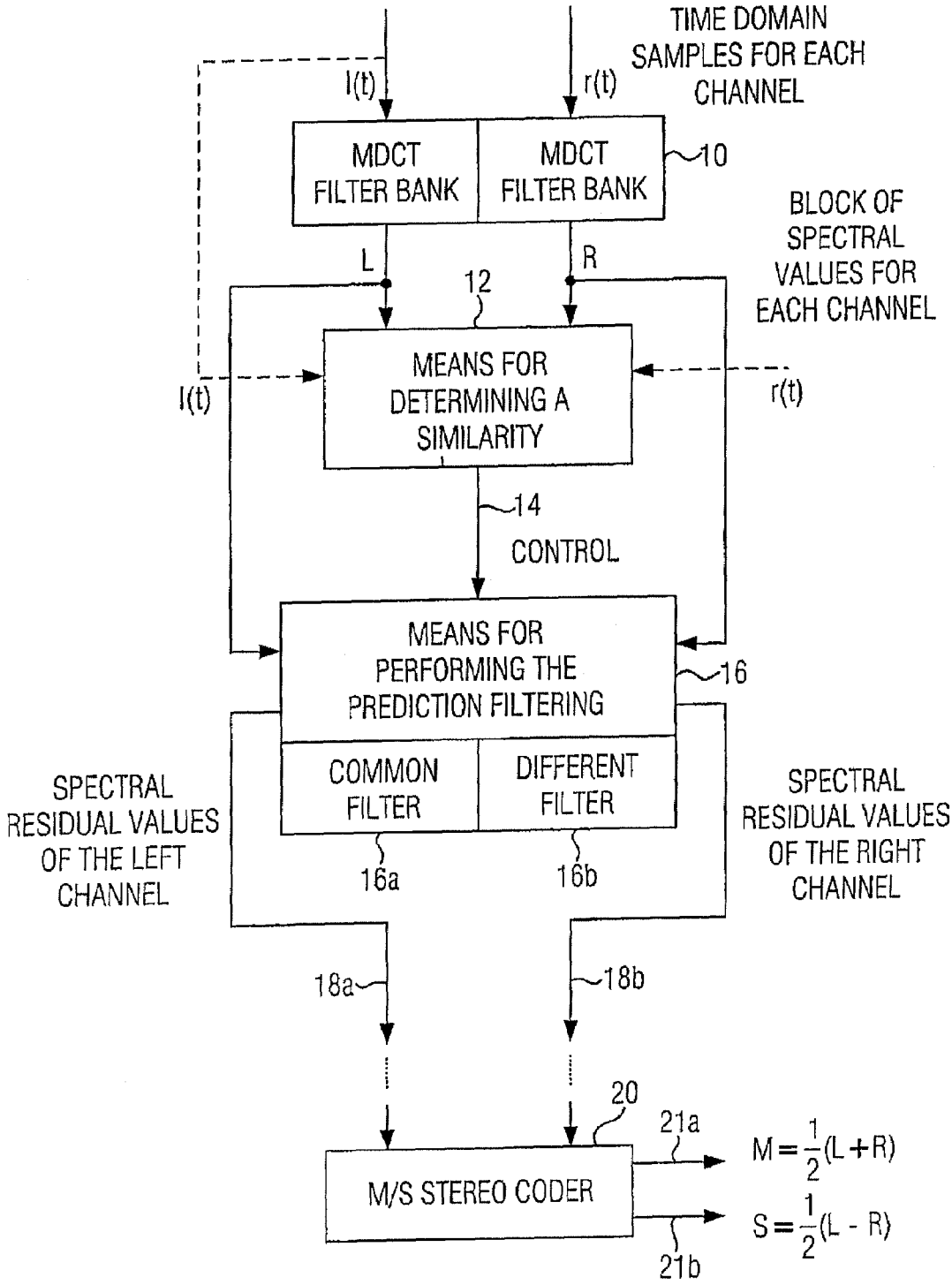
FIG. 1 is a block circuit diagram of an apparatus for processing a multi-channel signal according to the invention.

FIG. 1 shows an apparatus for processing a multi-channel signal, wherein the multi-channel signal is represented by one block of spectral values each for at least two channels, as it is shown by L and R. The blocks of spectral values are determined from time domain samples l(t) and/or r(t) for each channel by MDCT filtering, for example, by means of an MDCT filterbank 10.

In a preferred embodiment of the present invention, the blocks of spectral values for each channel are then supplied to a means 12 for determining a similarity between the two channels. Alternatively, the means for determining the similarity between the two channels may also, as it is shown in FIG. 1, be performed using time domain samples l(t) or r(t) for each channel. It is preferred, however, to use the blocks of spectral values obtained from the filterbank 10 for similarity determination, since these are equally influenced by possible effects of the filtering in the filterbank 10.

The means 12 for determining the similarity between the first and the second channel is operable to generate, on a control line 14, based on a similarity measure or alternatively a dissimilarity measure, a control signal, which has at least two states, one of which expresses that the blocks of spectral values of the two channels are similar, or which indicates in its other state that the blocks of spectral values for each channel are dissimilar. The decision as to whether similarity or dissimilarity prevails may be made using a preferably numerical similarity measure.

There are various possibilities for the determination of the similarity between the two blocks of spectral values for each channel, one possibility of which is a cross correlation calculation yielding a value that may then be compared to a predetermined similarity threshold. Alternative similarity measurement methods are known, a preferred form being described subsequently.

Both the block of spectral values for the left channel and the block of spectral values for the right channel are supplied to a means 16 for performing a prediction filtering. In particular, a prediction filtering is performed over the frequency, wherein the means for performing is formed to use a common prediction filter 16*a* for the block of spectral values of the first channel and for the block of spectral values of the second channel for performing the prediction over the frequency, when the similarity is greater than a threshold similarity. If the means 16 for performing the prediction filtering is, however, notified by the means 12 for determining a similarity that the two blocks of spectral values for each channel are dissimilar, i.e. have a similarity smaller than a threshold similarity, the means 16 for performing the prediction filtering will apply different filters 16*b* to the left and the right channel.

The output signals of the means 16 thus are spectral residual values of the left channel at an output 18*a* as well as spectral residual values of the right channel at an output 18*b*, wherein the spectral residual values of the two channels have been generated using the same prediction filter (case 16*a*) or using different prediction filters (case 16*b*), depending on the similarity of the left and the right channel.

Depending on the actual coder implementation, the spectral residual values of the left and of the right channel may be supplied either directly or after several processings, such as are provided in the AAC standard, to a mid/side stereo coder, which outputs the mid signal as half the sum of left and right channel at an output 21*a*, while the side signal is output as half the difference of left and right channel.

As it has been set forth, in case a high similarity between the channels existed before, the side signal is now smaller than in the case in which different TNS filters are used for similar channels, due to the synchronization of the TNS processing of the two channels, which thus holds out the prospect of a higher coding gain due to the fact that the side signal is smaller.

Subsequently, with reference to FIG. 2, a preferred embodiment of the present invention will be illustrated, in which in the means 12 for determining a similarity the first stage of the TNS calculation is already performed, namely the calculation of the Parcor and/or reflection coefficients and of the prediction gain for both the left channel and the right channel, as it is illustrated by the blocks 12*a*, 12*b*.

This TNS processing thus provides both the filter coefficients for the prediction filter to be used in the end and the prediction gain, wherein this prediction gain is also needed to decide whether a TNS processing is to be performed at all or not.

Figure 2:
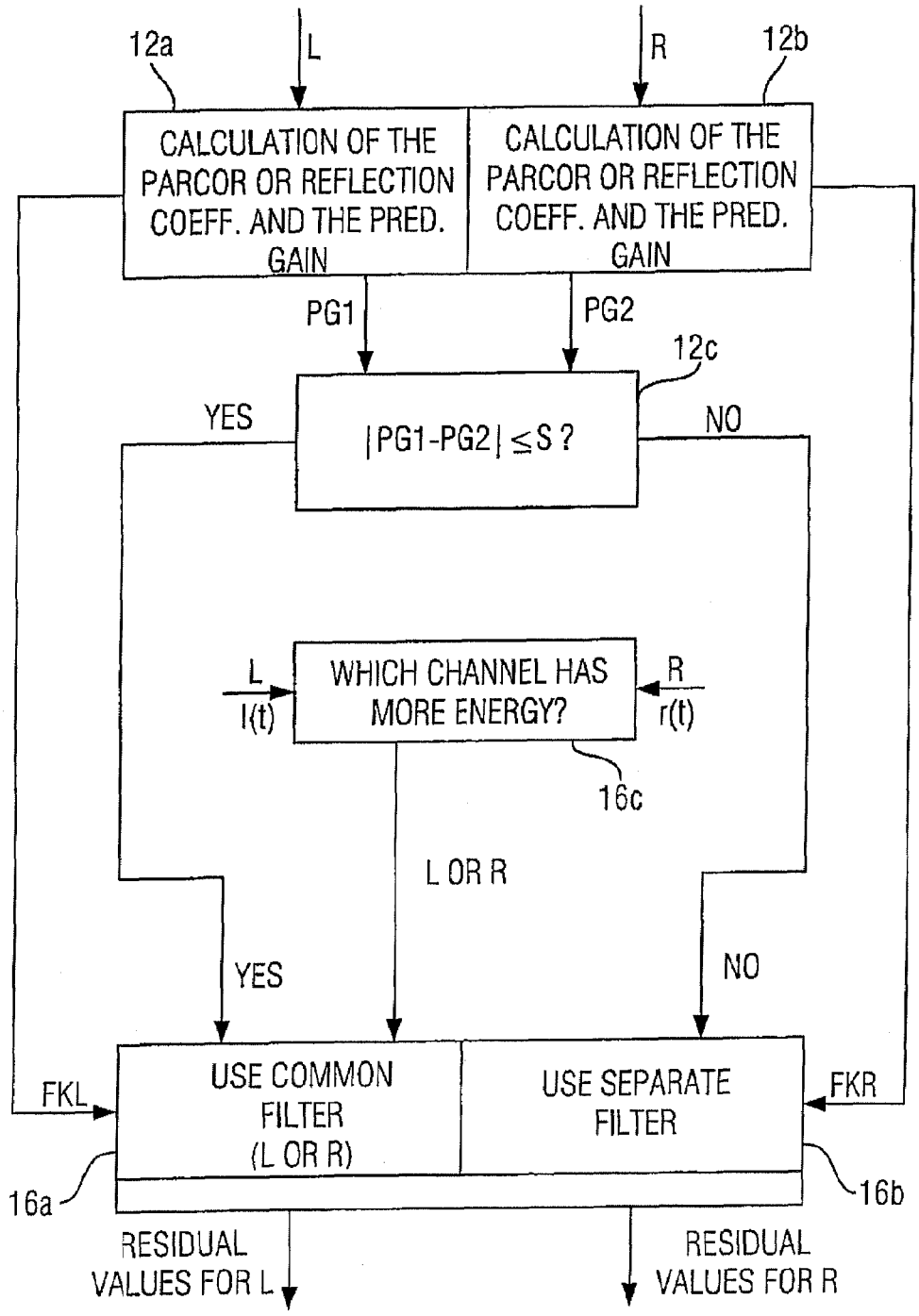
FIG. 2 shows a preferred embodiment of the means for determining a similarity and the means for forming the prediction filtering.
Figure 3:
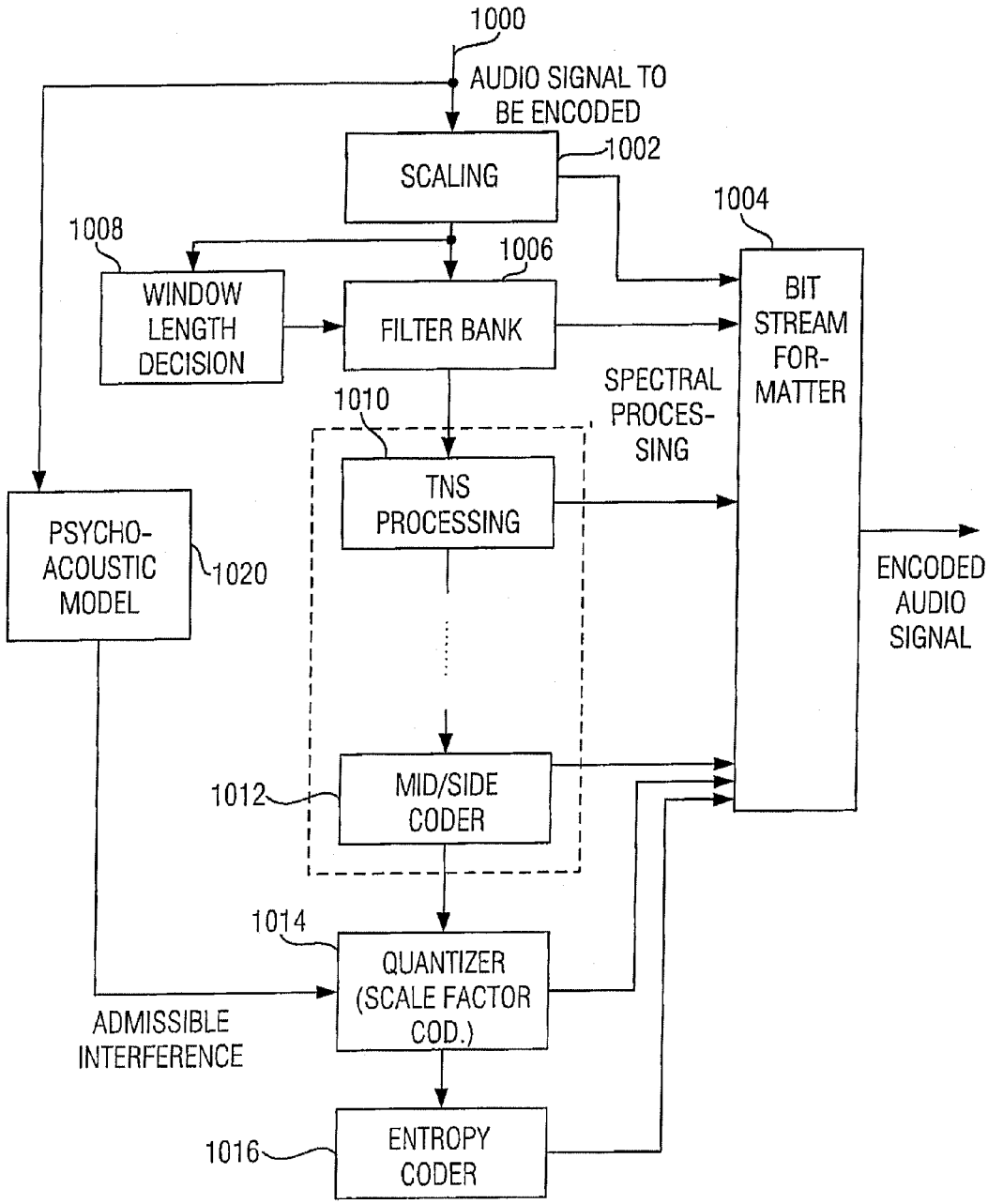
FIGURE 3 (PRIOR ART)
FIG. 3 is a block circuit diagram of a known audio coder according to the AAC standard.

The prediction gain for the first, left channel, which is designated with PG1 in FIG. 2, is fed to a similarity measure determination means, which is designated with 12*c* in FIG. 2, just like the prediction gain for the right channel, which is designated with PG2 in FIG. 2. This similarity determination means is operable to calculate the absolute magnitude of the difference or the relative difference of the two prediction gains and to see if this is below a predetermined deviation threshold S. If the absolute magnitude of the difference of the prediction gains lies below the threshold S, it is assumed that the two signals are similar, and the question in block 12*c* is answered yes. If it is ascertained, however, that the difference is greater than the similarity threshold S, the question is answered no. In case of an affirmative answer to this question, a common filter for both channels L and R is used in the means 16, whereas in case of the negative answer to the question in block 12*c* separate filters are used, i.e. a TNS processing like in the prior art can be performed.

To this end, a set of filter coefficients FKL for the left channel and a set of filter coefficients FKR for the right channels are supplied to the means 16 from the means 12*a* and/or 12*b*.

In a preferred embodiment of the present invention, a special selection is made in a block 16*c* for filtering by means of a common filter. In the block 16*c*, it is decided which channel has the greater energy. If it is ascertained that the left channel has the greater energy, the filter coefficients FKL calculated for the left channel by the means 12*a* are used for the common filtering. If it is, however, ascertained in the block 16*c* that the right channel has the greater energy, the set of filter coefficients FKR having been calculated for the right channel in the means 12*b* is used for the common filtering.

As can be seen from FIG. 2, both the time signal and the spectral signal may be used for the energy determination. Due to the fact that transformation artifacts, which have possibly taken place, are already contained in the spectral signals, it is preferred to use the spectral signals of the left and the right channel for the "energy decision" in the block 16*c*.

In a preferred embodiment of the present invention, a TNS synchronization, i.e. the use of the same filter coefficients for both channels, is employed if the prediction gains for the left and the right channel differ by less than three percent. If both channels differ by more than three percent, the question in the block 12*c* of FIG. 2 is answered "NO".

As it has already been set forth, the predictions gains of the two channels are compared in the filtering—in the sense of simple or little computation-intensive detection of the similarity. If a difference of the prediction gains falls below a certain threshold, both channels are imparted with the same TNS filtering in order to avoid the problems described.

Alternatively, a comparison of the reflection coefficients of the two separately calculated TNS filters may also take place.

Again alternatively, the similarity determination may also be achieved using other details of the signal, so that, when a similarity has been determined, only the TNS filter coefficient set for the channel that will employed for the prediction filtering of both stereo channels has to be calculated. This has the advantage that, when looking at FIG. 2 and if the signals are similar, only either the block 12*a* or the block 12*b* will be active.

Moreover, the inventive concept may further be employed so as to further reduce the bit rate of the encoded signal. While different TNS side information is transmitted with the use of two different reflection coefficients, TNS information for both channels only has to be transmitted once in the filtering of the two channels with the same prediction filter. Hence, by the inventive concept, a reduction in the bit rate may also be achieved in that a set of TNS side information is "saved" if the left and the right channel are similar.

The inventive concept basically is not limited to stereo signals, but could be applied in a multi-channel environment among various channel pairs or also groups of more than 2 channels.

As it has been stated, a determination of the cross correlation measure k between the left and the right channel or a determination of the TNS prediction gain and the TNS filter coefficients may take place separately for each channel for the similarity determination.

The synchronization decision takes place if k exceeds a threshold (e.g. 0.6) and MS stereo coding is activated. The MS criterion may also be omitted.

A determination of the reference channel the TNS filter of which is to be adopted for the other channel takes place in the synchronization. For example, the channel with the greater energy is used as reference channel. In particular, copying the TNS filter coefficients from the reference channel to the other channel takes place then.

Finally, an application of the synchronized or non-synchronized TNS filters to the spectrum takes place.

Alternatively, a determination of the TNS prediction gain and of the TNS filter coefficients takes place separately for each channel. Then a decision is made. If the prediction gain of both channels differs by not more than a certain measure, e.g. 3%, the synchronization takes place. Here, the reference channel may also be chosen arbitrarily if a similarity of the channels can be assumed. Here, there is also copying the TNS filter coefficients from the reference channel to the other channel, whereupon an application of the synchronized or non-synchronized TNS filters to the spectrum takes place.

The following are alternative possibilities: Whether TNS in a channel is, on principle, activated, depends on the prediction gain in this channel. If this exceeds a certain threshold, TNS is activated for this channel. Alternatively, also a TNS synchronization for two channels is made if TNS was activated only in one of both channels. Then it is a stipulation that, for example, the prediction gain is similar, i.e. one channel lies just above the activation limit, and one channel just below the activation limit. From this comparison, the activation of TNS for both channels with the same coefficients is then derived, or perhaps also the deactivation for both channels.

Depending on the circumstances, the inventive method of processing a multi-channel signal may be implemented in hardware or in software. The implementation may be on a digital storage medium, particularly a floppy disk or CD with electronically readable control signals capable of cooperating with a programmable computer system so that the method is executed. In general, the invention thus also consists in a computer program product with program code stored on a machine-readable carrier for performing the inventive method, when the computer program product is executed on a computer. In other words, the invention may thus also be realized as a computer program with program code for performing the method, when the computer program is executed on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for processing a multi-channel signal, wherein the multi-channel signal is represented by a block of spectral values each for at least two channels, comprising:

a similarity determinator for determining a similarity between a first one of the two channels and a second one of the two channels, wherein the similarity determinator is formed to calculate a first prediction gain from a prediction of the block of the first channel and a second prediction gain from a prediction of the block of the second channel, or first reflection coefficients for a first prediction filter for the first channel and second reflection coefficients for a second prediction filter of the second channel, and to obtain the similarity using the first prediction gain and the second prediction gain or using the first reflection coefficients and the second reflection coefficients;

a prediction filter processor performing a prediction filtering, wherein the prediction filter processor is formed to use a common prediction filter for the block of spectral values of the first channel and the block of spectral values of the second channel for performing the prediction filtering if a similarity is greater than a threshold similarity, or use two different prediction filters for performing the prediction filtering if the similarity is smaller than a threshold similarity.

2. The apparatus of claim 1, wherein the prediction filter processor is formed to output spectral residual values as a result of the prediction, and wherein the apparatus further comprises:

a joint coder for jointly coding spectral residual values or values of the first channel derived from the spectral residual values, and spectral residual values or values of the second channel derived from the spectral residual values, if the similarity is greater than a threshold similarity.

3. The apparatus of claim 2, wherein the joint coding is a mid/side coding.

4. The apparatus of claim 3, wherein the joint coder is formed to calculate a mid signal on the basis of a sum of the first and the second channel, and to calculate a side signal on the basis of a difference of the first and the second channel.

5. The apparatus of claim 1, wherein the block of spectral values for a channel represents a short-time spectrum of this channel, or wherein the block of spectral values includes a plurality of band-pass signals for a plurality of subbands.

6. The apparatus of claim 1, wherein the prediction filter processor is formed to perform a TNS processing.

7. The apparatus of claim 1, wherein the similarity determinator is formed to calculate a cross correlation of the first and the second channel.

8. The apparatus of claim 7, wherein the prediction filter processor is formed to use a single prediction filter if the first prediction gain and the second prediction gain differ by less than or equal to three percent.

9. The apparatus of claim 1, wherein the prediction filter processor is formed to use, as the common prediction filter, a prediction filter the coefficients of which are derived from the block of spectral values containing more energy than the other block of spectral values.

10. The apparatus of claim 1, wherein the prediction filter processor is formed to perform an autocorrelation calculation and an LPC calculation using the Levinson-Durbin algorithm on the block of spectral values for the prediction over the frequency, in order to obtain Parcor coefficients or reflection coefficients as well as a prediction gain, and to filter the block of spectral values with the Parcor coefficients to obtain spectral residual values.

11. A method of processing a multi-channel signal, wherein the multi-channel signal is represented by a block of spectral values each for at least two channels, comprising the steps of:

determining a similarity between a first one of the two channels and a second one of the two channels by calculating a first prediction gain from a prediction of the block of the first channel and a second prediction gain from a prediction of the block of the second channel, in order to obtain the similarity from the first prediction gain and the second prediction gain, or by calculating first reflection coefficients for a first prediction filter for the first channel and second reflection coefficients for a second prediction filter of the second channel, in order to obtain the similarity using the first reflection coefficients and the second reflection coefficients;

performing a prediction filtering with a common prediction filter for the block of spectral values of the first channel and the block of spectral values of the second channel if a similarity is greater than a threshold similarity, or performing the prediction filtering with two different prediction filters for the block of spectral values of the first channel and the block of spectral values of the second channel if the similarity is smaller than a threshold similarity.

12. A computer program with program code for performing, when the program is executed on a computer, a method of processing a multi-channel signal, wherein the multi-channel signal is represented by a block of spectral values each for at least two channels, comprising the steps of:

determining a similarity between a first one of the two channels and a second one of the two channels by calculating a first prediction gain from a prediction of the block of the first channel and a second prediction gain from a prediction of the block of the second channel, in order to obtain the similarity from the first prediction gain and the second prediction gain, or by calculating first reflection coefficients for a first prediction filter for the first channel and second reflection coefficients for a second prediction filter of the second channel, in order to obtain the similarity using the first reflection coefficients and the second reflection coefficients;

performing a prediction filtering with a common prediction filter for the block of spectral values of the first channel and the block of spectral values of the second channel if a similarity is greater than a threshold similarity, or performing the prediction filtering with two different prediction filters for the block of spectral values of the first channel and the block of spectral values of the second channel if the similarity is smaller than a threshold similarity.

* * * * *